US005749972A

United States Patent [19]

Bernert et al.

[11] Patent Number: 5,749,972

[45] Date of Patent: May 12, 1998

[54] APPARATUS FOR THE APPLICATION OF AT LEAST ONE LIQUID MEDIUM ONTO A MOVING MATERIAL WEB

[75] Inventors: Richard Bernert, Giengen; Stefan Reich, Heidenheim, both of Germany

[73] Assignee: Voith Sulzer Papiermaschinen GmbH, Heidenheim, Germany

[21] Appl. No.: 420,471

[22] Filed: Apr. 12, 1995

[30] Foreign Application Priority Data

Apr. 15, 1994 [DE] Germany ..... 44 13 232.8

[51] Int. Cl.[6] ..... B05C 3/02; B05C 11/02

[52] U.S. Cl. ..... 118/414; 118/410; 118/126; 118/231

[58] Field of Search ..... 118/258, 256, 118/261, 263, 231, 230, 232, 233, 126, 410, 413, 414, 419; 427/355, 356, 359

[56] References Cited

U.S. PATENT DOCUMENTS

| | | | |
|---|---|---|---|
| 4,869,933 | 9/1989 | Sollinger et al. | 118/410 |
| 4,887,547 | 12/1989 | Sommer et al. | 118/410 |
| 5,286,526 | 2/1994 | Rantanen et al. | 427/356 |
| 5,454,870 | 10/1995 | Sieberth | 118/216 |

FOREIGN PATENT DOCUMENTS

| | | |
|---|---|---|
| A-3623402 | 7/1985 | Germany . |
| A-8414904 | 2/1986 | Germany . |
| A-3713278 | 4/1986 | Germany . |
| A-3735889 | 10/1986 | Germany . |

*Primary Examiner*—Donald E. Czaja
*Assistant Examiner*—Calvin Padgett
*Attorney, Agent, or Firm*—Sughrue, Mion, Zinn, Macpeak & Seas, PLLC

[57] ABSTRACT

Apparatus for the application of at least one liquid medium onto a moving material web, in particular of paper or cardboard, including an application mechanism (3) for the liquid medium and a roller (2) associated with the application mechanism for receiving the liquid medium in the case of an indirect application or for guiding the material web in the case of direct application, the application mechanism (3) including a dosaging blade (4) and a damming strip (7) arranged at a distance from the dosaging blade as seen against the direction of rotation of the roller (2), the damming strip together with the dosaging blade defining an application chamber (6), a running-off surface (8) over which the excess liquid medium flows out of the application chamber (6) and over the damming strip (7), and wherein the dosaging blade (4) has a blade holder (5) with a base strip (**5*b*) mounted in the application mechanism (3). The blade holder (5) is bent in such a manner that the cross-sectional extension (R) of the base strip (5*b*) forms an angle (α') with the roller rotational direction (T) at the dosaging blade (4**) of at least approximately 90° or more.

12 Claims, 6 Drawing Sheets

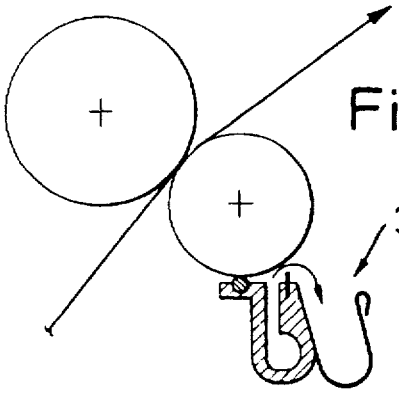
Fig. 4
Fig. 5
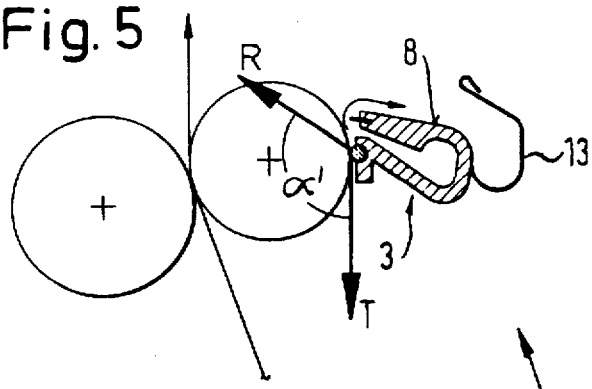
Fig. 6
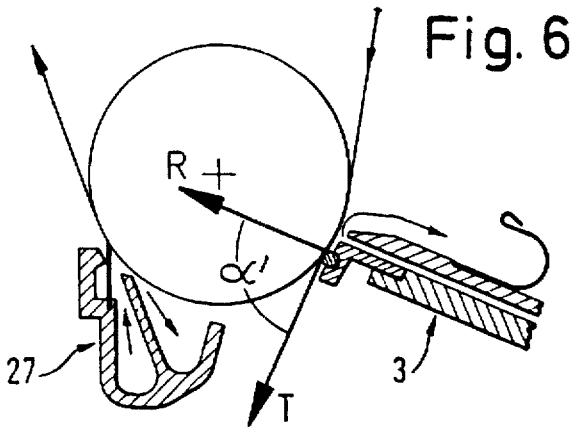
Fig. 7
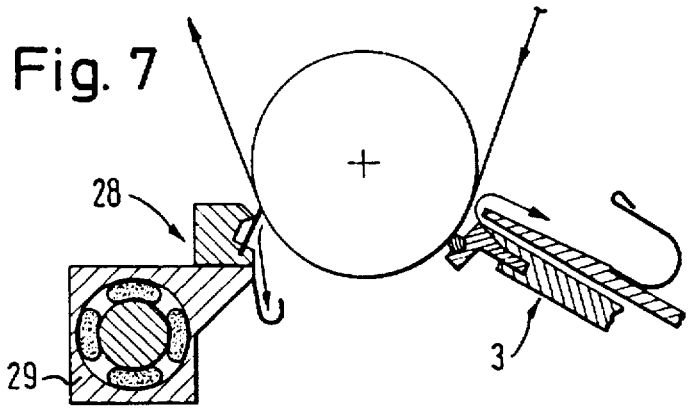

APPARATUS FOR THE APPLICATION OF AT LEAST ONE LIQUID MEDIUM ONTO A MOVING MATERIAL WEB

BACKGROUND OF THE INVENTION

The invention relates to an apparatus for the application of at least one liquid medium onto a moving material web, in particular paper or cardboard.

In such apparatus, a liquid medium such as ink, impregnating fluid, starch or the like is applied onto the material web. The liquid medium can have a different consistency depending on the type of application, for example, it can be thick or thin. The material web can consist of paper or cardboard, but it can also, for example, consist of a textile material. The application of the liquid medium on the moving material web ensues either directly or indirectly. In the case of direct application, the material web is passed by the application mechanism on the shell surface of a roller and the liquid medium is directly applied onto the material web upon passing the application mechanism. Here, the roller serves as a counter-roller to the application mechanism. In the case of indirect application of the liquid medium, the roller serves as application roller, i.e. the liquid medium is first applied onto the application roller and subsequently received by the conveyed material web through contact with the roller, preferably in a two-roller press nip.

It is desirable in many kinds of application to lead the moving material web past the roller from the below to above with respect to the horizontal plane. For example, the drying devices for the material web treated with the liquid medium can then be arranged in an area above the roller with respect to the horizontal plane. This is advantageous because upward removal of warm air from the drying devices is then not hindered by the application apparatus. Additionally, one avoids in this way that soiled cleaning water can drop onto the drying devices during cleaning of the application apparatus. Furthermore, in case of a web break, waste paper in front of the application apparatus is easily removed under the influence of gravity.

Up to now, in the case of such material web guidance from the below to above, application apparatus were used of a type in which a liquid sump is formed between an application roll and a dosaging element, i.e. a free liquid level is formed with the liquid medium being supplied directly to the dosaging element. In the through-put direction of the material web from below to above, such an application mechanism can then be arranged at the application roller with a sufficient distance from the press nip so that the covering quality on the application roller between the application mechanism and the point where the material web receives the liquid can be optically controlled. An application mechanism in which a free liquid level is formed is, however, unsuitable for many types of use as, on the one hand, turbulent conditions form in the sump in the case of high operating speeds which lead to liquid medium being splashed out of the sump and, on the other hand, the air boundary layer present on the roller shell surface is at least partially transported through the sump and this can cause coating faults.

An application mechanism is described in German utility model DE-GM 84 14 904.3 which is located approximately at the six o'clock position of the opposite roll as seen in cross-section. However, it is a disadvantage of the described application mechanism that this can only be arranged within a small area about the described position, because the running off of the excess medium is no longer guaranteed in the case of greater distances from this position. Additionally, in the case of such an arrangement of the application mechanism, the material web can only be looked at with difficulty by the operating personel, which makes an optical examination of the coating quality practically impossible.

SUMMARY OF THE INVENTION

The invention is based on the problem of providing an apparatus for the application of at least one liquid medium onto a moving material web in which the application mechanism can be arranged in a wide area of the downwardly moving sector of the shell surface without the operation of the application mechanism being impared.

An application mechanism is provided in the apparatus according to the invention which has a dosaging blade as well as a damming strip spaced from the blade in a direction opposite to the rotational direction of the roller, the damming strip defining an application chamber with the dosaging blade. The blade holder of the application mechanism is bent in such a manner that the cross-sectional extension of the base strip forms an angle with the roller rotational direction at the dosaging blade of approximately 90° or more. In this manner, even when the application mechanism is mounted in the two o'clock position, a running-off of the excessive medium is guaranteed. In this case, the blade base fits in an advantageous manner into the area of the structural arrangements in the vicinity of the application chamber. The one flank of the bent blade base can then define a supply gap to supply the liquid medium into the application chamber while the other flank, which is bent with respect to the first flank and holds the actual blade element, can define part of the application chamber.

In accordance with the invention, the application mechanism is in this case arranged in a downstream sector of the shell surface of the roller. In other words: with reference to a vertical plane passing through the roller axis, the application mechanism is arranged at that half of the roller shell surface in which a point on the shell surface of the roller moves from above to below with respect to a horizontal plane on account of the roller rotation. As the damming strip is spaced from the dosaging blade in a direction opposite to the rotational direction of the roller, it is therefore spatially higher than the dosaging blade with respect to a horizontal plane. In order to enable a flowing away of excess liquid medium flowing out of the application chamber over the damming strip under the influence of gravity, a running-off surface is provided in accordance with the invention which forms an acute angle with a horizontal plane.

Although the damming strip is spatially higher than the dosaging blade and excess medium therefore initially flows out of the application chamber against the direction in which gravitational force takes effect, i.e. it must flow upwards, a flowing away of excess liquid medium is realized without problems in accordance with the invention. The excess liquid medium flows away between the roller and the damming strip against the rotational direction of the roller and provides for an effective release of the air boundary layer from the roller surface. The air boundary layer could otherwise reach through the application chamber to the dosaging blade and lead to a faulty coating on account of the formation of air bubbles.

Due to the inventive positioning of the application mechanism in the downwardly moving sector of the roller shell surface, in the case of indirect application and a guidance of the material web with respect to a horizontal plane from below to above, at least a lower quarter circle sector of the roller shell surface with respect to a horizontal plane in which a point on the roller surface moves upwardly again remains easily visible from below for the operating personal. Thus, the coating quality on the application roller between the application mechanism and the material web can be directly optically controlled.

However, the apparatus according to the invention can also be used in an advantageous manner in the case of direct application of a liquid medium onto a material web which is guided about a counter-roller. Thus, analogously to the previously described arrangement in the case of indirect application, an optical control from below by the operating personal of the coating applied onto the material web is possible after direct application. Further, in the apparatus according to the invention, an inventive application mechanism can be arranged at the lower half of the roller shell surface, with respect to a horizontal plane extending through the roller axis, in the downwardly moving quarter circle sector of the roller surface and it is additionally possible to provide a second application mechanism in the commonly known manner in the second quarter circle sector in which the shell surface moves upwards. Thus, in the case of direct application, for example, two different coatings can be applied successively on the material web. Naturally, the application mechanism arranged in accordance with the invention in the downwardly moving half of the roller shell surface can also be arranged in this case above the horizontal plane passing through the roller axis.

The downwardly moving sector of the roller shell surface in which the application mechanism is arranged extends with respect to a horizontal plane passing through the roller axis preferably about an arcuate angular range of 30° upwards and an arcuate angular range of 90° downwards. In other words, it is advantageous in accordance with the invention, as seen in the direction of the roller longitudinal axis, in the case of roller rotation in the clockwise direction, for the application mechanism to be arranged in a region which extends from the two o'clock position to the six o'clock position of the roller surface and, in the case of roller rotation in the counter-clockwise direction, to arrange it in a region which extends from the ten o'clock position to the six o'clock position.

The application mechanism cab be arranged in a downwardly moving sector of the roller shell surface which extends downwardly in an arcuate angular region of 90° from a horizontal plane extending through the roller axis. Upon rotation of the roller in the clockwise direction, this corresponds to a region of approximately the three o'clock position to approximately the six o'clock position of the roller shell surface and, upon rotation of the roller in the counter-clockwise direction, to a region from the nine o'clock position also to the six o'clock position. A preferred position for the arrangement of the application mechanism is in this case at the four o'clock position for a roller rotation in the clockwise direction, i.e. the position at an arcuate angle of approximately 30° beneath a horizontal plane passing through the roller axis or, for a roller rotation in the counter-clockwise direction, at the eight o'clock position, i.e. the mirror position to the four o'clock position with respect to a vertical plane passing through the roller axis. This applies, for example, in respect of an approximately vertical direction of movement of the web in the case of indirect application. For a web moving at an angle from below to above through a two-roller pressure opening (also in the case of indirect application), a preferred position of the application mechanism is approximately the six o'clock position at the lower roller or, approximately the three (or nine) o'clock position at the upper roller.

It is furthermore useful in accordance with the invention to provide the application mechanism with a pressing device for the dosaging blade, the pressing force of the pressing device being variably adjustable across the roller width. Thus, the transverse profile of a coating applied into a material web, namely the coating profile in the direction perpendicular to the through-put direction of the material web, can be precisely adjusted. In a favourable embodiment, the adjustment of the pressing force ensues either manually or automatically by means of adjusting elements. These adjusting elements, for example adjusting spindles distributed across the width of the roller, then press onto a pressing element, as for example a pressing tube filled with pressurized air. A preferred inventive embodiment consists in forming the adjusting elements as bendable spindle shafts so that these can easily be adapted to the structural conditions of the application mechanism and, for example, can be guided externally about the application mechanism up to the pressing element. By means of an appropriate adjustment of the various adjustable spindles, either by hand with adjusting hand dials or automatically by means of actuating motors, the local pressing force of the adjusting spindles onto the pressing element can be regulated, and thus the local pressing force of the blade element against the roller.

It is a further feature of the invention that the force which holds the blade holder in the application mechanism acts substantially perpendicularly or at an angle greater than 90° to the force which presses the blade element against the roller. In this manner, the blade holder can be easily removed.

In accordance with the invention, two embodiments are preferred for the arrangement relative to each other of the running-off surface and a supply channel for the liquid medium. On the one hand, it is favourable to arrange the supply channel and the running-off surface in such a manner that they extend respectively on different sides of the damming strip with respect to a roller peripheral direction. In the case of this variant, the supply paths for the liquid medium to the application chamber can then be spatially separated from the running-off paths for the excess liquid medium. This leads to a relatively uncomplicated design of the supply and removal paths. Adjusting elements for regulating the pressing force against the dosaging blade can then, for example, be led in the form of bendable spindle shafts around the application mechanism when a radial extension of the spindle shafts towards the dosaging blade would otherwise have to be led through the supply paths for the liquid medium. A second favourable variant consists of the running-off surface and a supply channel for the liquid medium being respectively arranged on the same side of the damming strip. The removal path for the excess liquid medium, for example from the running-off surface into a collecting trough, and the path from the supply channel to the application chamber can then be formed in such a manner that they cross each other. This variant allows an approximately radial guidance of the adjusting elements, for example the adjusting spindles, towards the dosaging blade with reference to the roller axis without crossing the supply paths for the liquid medium. This mode of construction is suitable particularly for an arrangement in the region of the three o'clock position.

In accordance with the invention, it is also useful for supplying the liquid medium into the application chamber to form a supply gap in such a manner that it enters approximately radially into the application chamber with reference to the roller axis.

BRIEF DESCRIPTION OF THE DRAWINGS

In the following, exemplary embodiments of the apparatus according to the invention are described in more detail with reference to the drawings, in which:

FIGS. 4 to 7 shows schematically and in a greatly simplified form four further assembly states with apparatus of the inventive type;

DETAILED DESCRIPTION OF THE INVENTION

Figure 1:
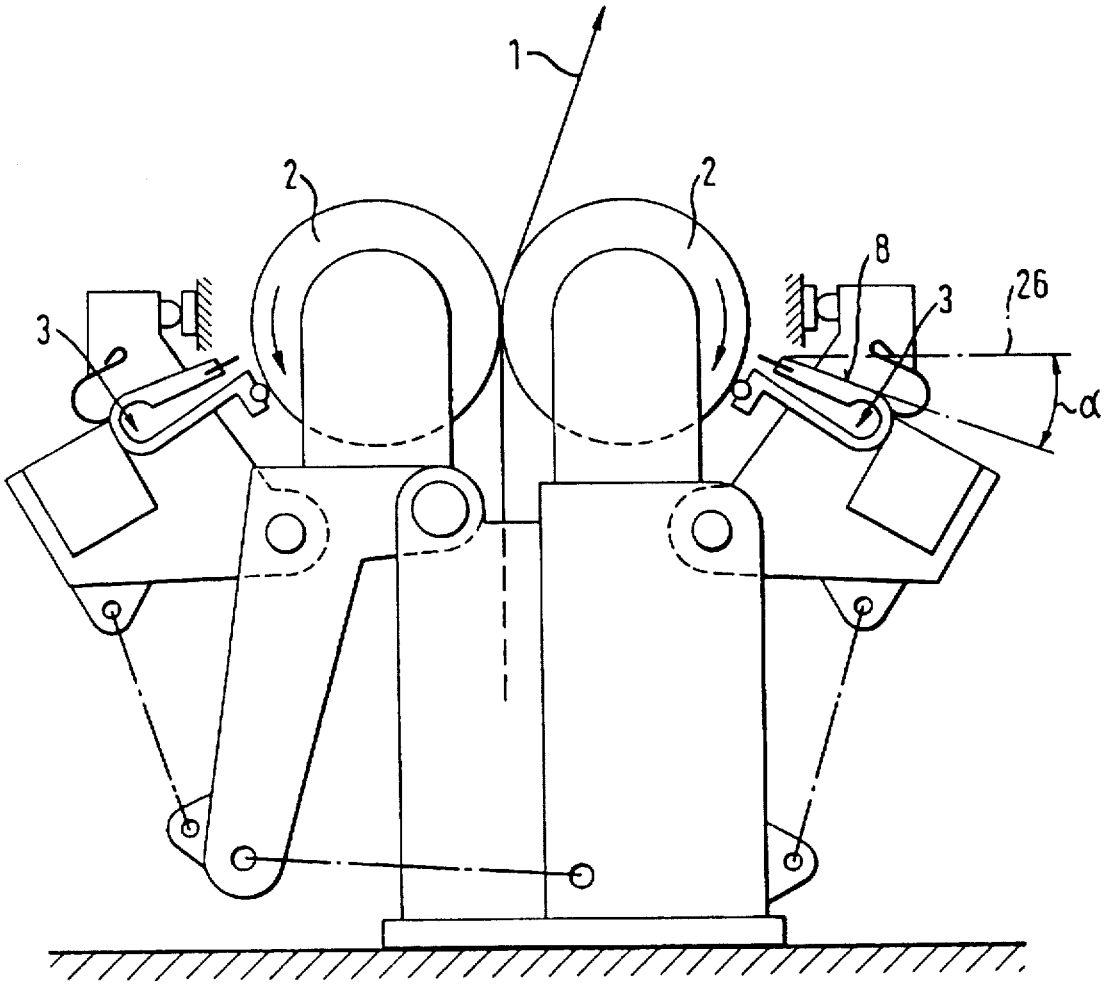
FIG. 1 shows an assembly state of two apparatus according to the invention in an application machine as seen in the direction of the roller rotational axes.

FIG. 1 shows a machine for applying a liquid medium, for example starch or a liquid with dye pigments, onto a material web 1 which, for example, consists of paper or cardboard. Two rollers 2 form a roller gap therebetween and respectively rotate in the rotational direction indicated with an arrow so that the material web 1 is conveyed from below to above through the roller gap with reference to a horizontal plane through the roller rotational axes. Application mechanisms 3 are arranged in mirror symmetry on both rollers 2 and the liquid medium is applied onto the surfaces of the rollers 2 with these in order to then be transferred by the rollers in the roller gap onto the material web 1, on account of which an application of the liquid medium onto the material web takes place on both sides.

Both application mechanisms 3 are respectively arranged in a position at the rollers 2 at which a point on the roller surface moves downwardly with respect to a horizontal plane. With respect to the associated roller 2 which turns in the clockwise direction, the right-hand application mechanism 3 is arranged at a location which would correspond to the four o'clock position on a clock face projected onto the roller cross-section. In mirror symmetry to this with respect to both rollers, the left-hand application mechanism 3 is arranged at a location on the left-hand roller 2 rotating in the counter clockwise direction which would correspond to the eight o'clock position on a clock face. The structural details of the support of the application mechanisms 3 on the machine arrangement is not described in detail here as this corresponds to the usual mode of construction.

As may be taken from the machine arrangement in FIG. 1, the operating personal can examine from below the liquid film applied to the rollers with respect to its quality at each roller 2 in the shown configuration in the region between the application mechanism 3 and the material web 1. Thus, possible faults in the film on the rollers are easily recognized and may be easily allocated to the respective application mechanism. However, after the successful application of the liquid medium onto both sides of the material web, this allocation is no longer possible with certainty in the through-light.

In the following, the structural details of a first exemplary embodiment of the application apparatus according to the invention is now described with reference to FIG. 2. This shows in cross-section an application mechanism 3, corresponding to the arrangement of the right-hand application mechanism as shown in FIG. 1, with reference to the roller 2, which rotates in the direction of the arrow T.

A blade base or holder 5 arranged in the application mechanism 3 is held there by a force K and has a blade element 4 mounted thereon. The blade element 4 lies against the roller 2 and can be a rolling blade, a blade bar, a doctor blade or the like. The blade base 5 has a bent profile consisting of a flank 5*a* and a flank or base strip 5*b*. The extension of the flank 5*b* is indicated by arrow R. A damming strip 7 is arranged above the blade element 4 with reference to a horizontal plane. The blade element 4, the flank 5*a* of the bent blade base, the damming strip 7 and the section of the roller shell surface respectively located between the blade element and the damming strip encompass an application chamber 6. A supply channel 11 is connected via distribution bores 23 with an equalizing space 12, which is itself connected via a supply gap 9 with the application chamber 6.

The damming strip 7 is fixed in a front wall 10, the outer surface of which is formed as a running-off surface 8. A collecting trough 13 adjoins the running-off surface 8. The front wall 10 together with the damming strip 7 and the collecting trough 13 are pivotable about a pivot 14, for example, for cleaning purposes.

Figure 2:
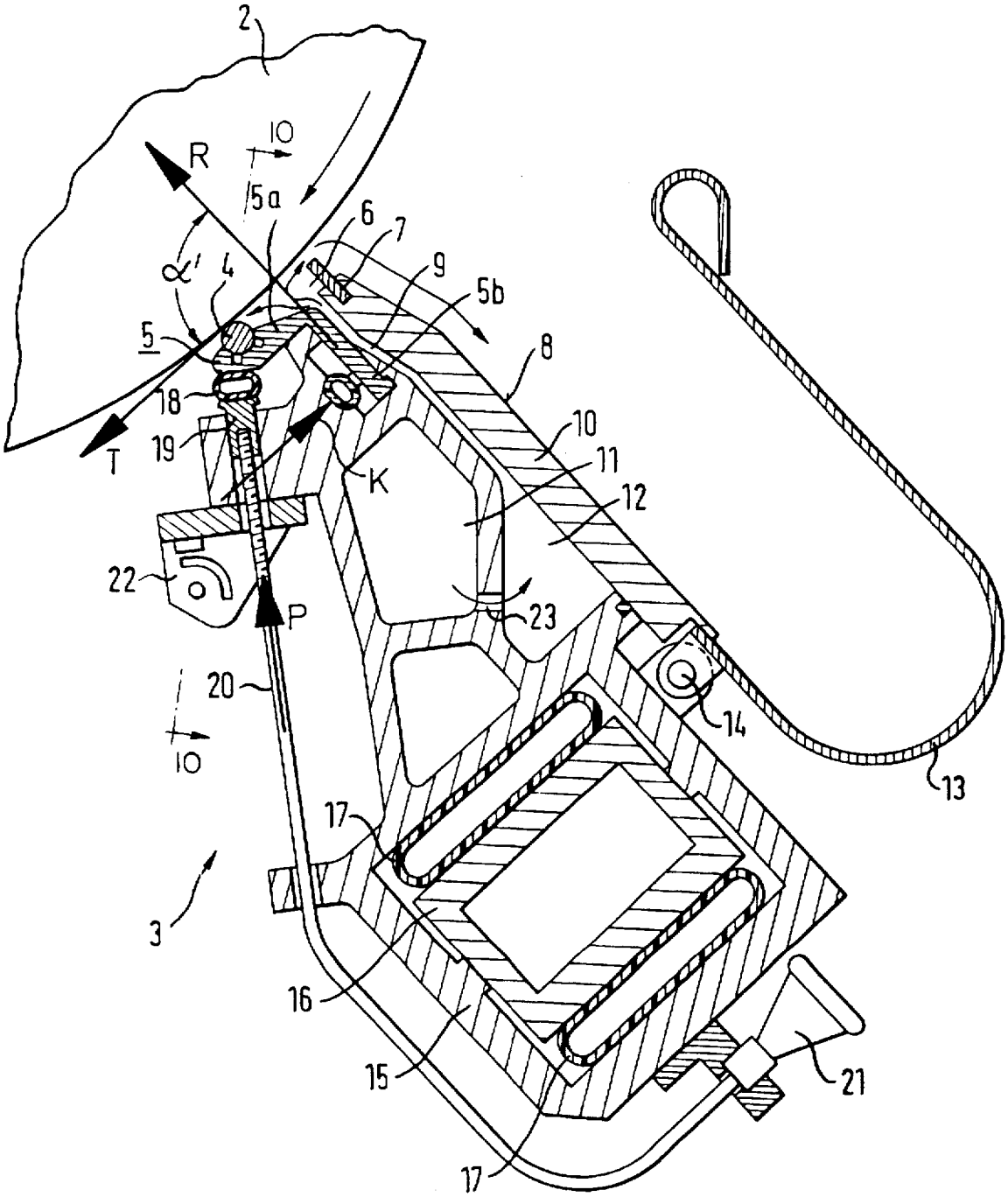
FIG. 2 shows a first exemplary embodiment of the apparatus according to the invention in schematic transverse cross section.
Figure 3:
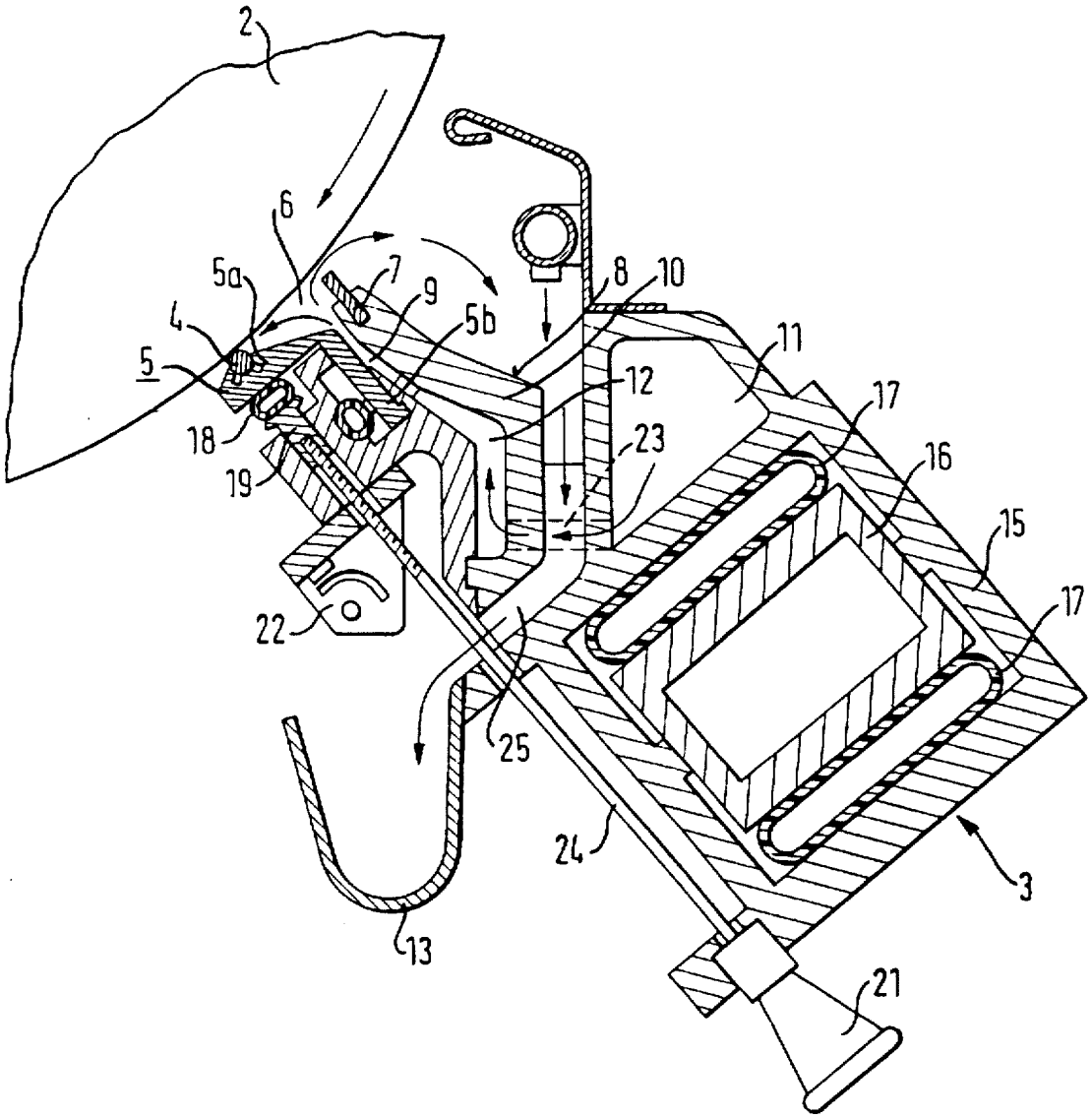
FIG. 3 shows a second exemplary embodiment of an apparatus according to the invention in schematic transverse cross section.
Figure 8:
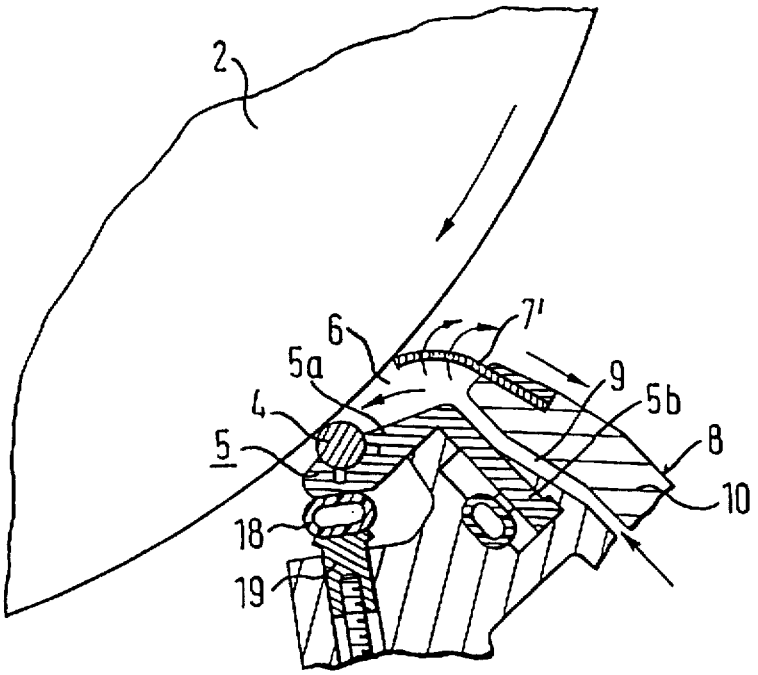
FIG. 8 shows schematically and in a greatly simplied form a further structural detail of the applicator apparatus according to the invention.
Figure 10:
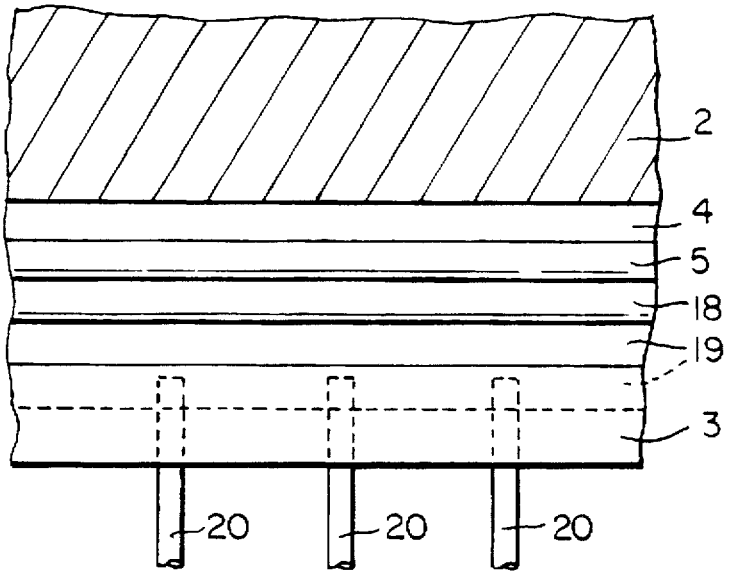
FIG. 10 is a partial sectional view taken along the line 10—10 in FIG. 2.

Instead of a damming strip 7 ending at a distance from the shell surface of the roller 2, as used in the exemplary embodiments accordings to FIGS. 2 and 3, a damming strip 7' can also be used which reaches to the shell surface of the roller, as illustrated in FIG. 8. This damming strip 7' is formed as a blade with through-openings which cleans the shell surface.

The application mechanism 3 according to the exemplary embodiment of FIG. 2 additionally includes a hollow beam 15 as well as a flexible yoke 16 within the beam. Two opposing surfaces of the yoke 16, which is also formed as a beam, point approximately in the radial direction with reference to the roller rotational axis and are supported against the beam 15 by means of pressure cushions 17. Additionally, a measuring device 22 is provided for measuring the bending of the application mechanism. The beam 15, the yoke 16, the pressure cushion 17 and the measuring device 22 are components of a bending compensation system for the application mechanism.

Finally, the application mechanism has a pressing tube 18 which extends across the entire width of the application mechanism 3 and contacts the flank 5*a* of the bent blade base 5. The pressing tube 18 is subjected to pressure by a pressing bar 19 which also extends continuously. The vector of the pressing force is denoted by the arrow P. Spindle shafts 20 are distributed across the width of the application mechanism 3, provided at their one end with a hand-adjusted dial 21 and are in active connection at their other ends with the pressing bar 19. The pressing tube 18, the pressing bar 19 and the adjusting spindles 20, which are designed as bendable shafts or as cardan shafts, form a system by means of which the pressing of the blade element 4 against the roller 2 can be variably adjusted across the length of the application mechanism in order to adjust the transverse coating profile on the roller surface.

In the following, the mode of operation of the previously described application mechanism 3 will be explained. The liquid medium to be applied onto the material web 1 (compare FIG. 1) is supplied to the application mechanism 3 by means of the supply channel 11, from which it is guided via the distribution bores 23 into the equalizing space 12 and then flows via the supply gap 9 into the application chamber 6. The liquid medium is in this case under pressure so that the application chamber 6 represents a pressure chamber in which a pressure which is as even as possible should be built up to which the blade element 4 is exposed by the liquid medium so that liquid medium is applied onto the roller surface by the blade element 4 with a desired coating thickness. Excess liquid medium passes between the damming strip 7 and the roller surface or, as shown in FIG. 8, when using an apertured blade, as a damming strip 7', the excess liquid medium which reaches to the roller shell surface passes through the through-openings of the damming strip 7' and flows under the influence of gravitational force evenly over the running-off surface 8 into the collecting trough 13. The liquid medium collected in the collecting trough is fed back to the application mechanism, possibly after passing through a cleaning filter. On account of the excess liquid medium passing between the damming strip 7 and the roller 2, a sealing flow is formed in the gap between the damming strip and the roller. The formation of this sealing flow at the roller surface with a flow direction against the rotational direction of the roller has the very favourable effect that the air boundary surface at the rotating roller surface is released by the counter flow between the damming strip and the roller (or the through-openings when using the apertured blade according to FIG. 8) and thus prevents the air boundary layer being broken up to the blade element 4, unlike the situation in commonly known application rollers operating with a basin with a free liquid level which may result in coating faults.

Although in the case of the apparatus according to the invention the damming strip 7 is higher than the blade element 4 with reference to a horizontal plane, a problem-free operation of the application mechanism and an even running-off of excess liquid medium out of the application chamber 6 is ensured.

The basic operation of the bending compensation arrangement is now explained. The measuring device 22 measures a bending of the application mechanism 3 in a known manner. Should a bending of the application beam 15 in the radial direction with reference to the roller axis be registered, the pressing cushions 17 respectively supported between the yoke 16 and the beam 15 are correspondingly exposed to a more or less highly pressurized medium, for example compressed air, in order to compensate the bending in the radial direction. A compensation of the bending in the radial direction is particularly important for the application mechanism because radial bending leads to faults in the transverse profile of the coating. Naturally, a compensation of the bending can additionally be provided in the peripheral direction of the roller by means of further pressing cushions. In addition to the described mechanical compensation of the bending, a thermal compensation of the bending can also be provided in the known manner.

The pressing system for the dosaging blade operates in such a manner that locally different pressing forces are transferred onto the pressing tube 18 by means of different adjustments of the adjusting spindles 20 across the width of the application mechanism, which forces are further transferred via the flank **5*a* of the blade base 5 to the blade element 4. Thus, on the one hand, a specified transverse coating profile is made possible, for example in such a manner that the coating at the sides of the material web should decrease outwardly towards the edges as is, on the other hand, a correction of irregularities in the transverse coating profile. Should the adjusting spindles 20** be automatically controlled by means of appropriate actuating motors, an automatic feedback can be provided between a measuring station which monitors the quality of the coating and a subsequent adjustment of the adjusting spindles.

A second exemplary embodiment is illustrated in FIG. 3 in which those parts and components corresponding to the exemplary embodiment shown in FIG. 2 are denoted with the same reference signs. To the extent that they have already been explained in respect of the first exemplary embodiment according to FIG. 2, corresponding structural units and their mode of operation in the second exemplary embodiment are not explained again. In the second exemplary embodiment, the supply channel is arranged on the same side of the damming strip 7 as the running-off surface 8 as seen in the peripheral direction of the roller 2. As the supply channel 11 is arranged radially outwardly behind the running-off surface 8 with reference to the roller axis, a collecting trough cannot be located at the same place as the exemplary embodiment according to FIG. 2. Therefore, as illustrated in FIG. 3, an overflow channel 25 is provided which is led from the running-off surface 8 to a collecting trough 13 located on the other side of the damming strip 7 on the application mechanism 3. As in the case of the first exemplary embodiment, distribution lines 23 are led from the supply channel 11 to the equalizing space 12 which then mouths via the supply gap 9 into the application chamber 6. However, in the second exemplary embodiment, the supply stream and the overflow stream of the liquid medium cross each other, as illustrated by the relevant flow arrows.

On account of the altered arrangement of the supply channel 11 and the different crossed guidance of the flows, as shown in FIG. 3, the adjusting spindles can be formed as rigid adjusting spindles 24 since they must merely cross the overflow stream flowing into the collecting trough 13. In contrast, a substantially radially extension of the adjusting spindles 20 with reference to the rollers axis corresponding to the adjusting spindles 24 in FIG. 3 is not possible as in the first exemplary embodiment according to FIG. 2, since the adjusting spindles 20 would then extend through the supply channel 11, which would unallowably have a detrimental effect on the flow conditions. However, straight, rigid adjusting spindles can be provided in the first exemplary embodiment in FIG. 2 as in the second exemplary embodiment in that the adjusting spindles 20 are shortened in the upper region shown in FIG. 2 with a straight extension or one which extends straight downwards in the direction of this upper region. For example, an actuating rotor can be arranged in the region beneath the measuring device 22 on the left-hand side of the application mechanism 3 as seen in FIG. 2.

Apparatus of the inventive kind are used in the assembly states illustrated in FIGS. 4 and 5 which serve to provide a one-sided and direct application of liquid medium onto a moving material web.

In the assembly state shown in FIG. 4, the material web runs at an angle of approximately 45° from below to above through the apparatus through a pressing gap formed by two rollers. In this arrangement the application mechanism 3 is located at the lower roller approximately at the six o'clock position.

In the assembly state illustrated in FIG. 5, the material web extends at an angle from below into the pressing gap and then approximately perpendicularly upwards. The application mechanism 3 is itself located in this variant approximately at the three o'clock position, wherein the arrows R and T already mentioned with respect to FIG. 2 form an angle $\alpha'>90°$. The running-off surface 8 is still angled at a sufficiently acute angle with respect to the horizontal in such a manner that the liquid medium passing over the damming strip can still flow down into the collecting trough 13 under the influence of gravitational force.

In the assembly state shown in FIGS. 6 and 7, apparatus according to the invention are used which are set up to directly apply liquid medium onto a moving material web.

In the case of the assembly state illustrated in FIG. 6, the application of the liquid medium ensues in two steps. While a first layer is applied by means of an application mechanism 3 of the type according to the invention which is located approximately at the four o'clock position and in which the arrows R and T already mentioned with respect to FIG. 2 form an angle $\alpha'<90°$, the application of the second coating is effected by means of a nozzle application mechanism 27 of the known type arranged approximately at the eight o'clock position.

In the case of the arrangement according to FIG. 7, the application of the liquid medium takes place by means of a so-called pre- and finish-dosing. While the predosing takes place by means of an application mechanism of the inventive kind located approximately at the four o'clock position, the finish-dosing is realised with a blade stripping unit 28 of known construction arranged approximately at the eight o'clock position. This blade stripping unit 28 is mounted on a beam 29 of known construction in which the bending and thus the coating thickness can be precisely adjusted for fine dosing across the beam length.

Figure 9:
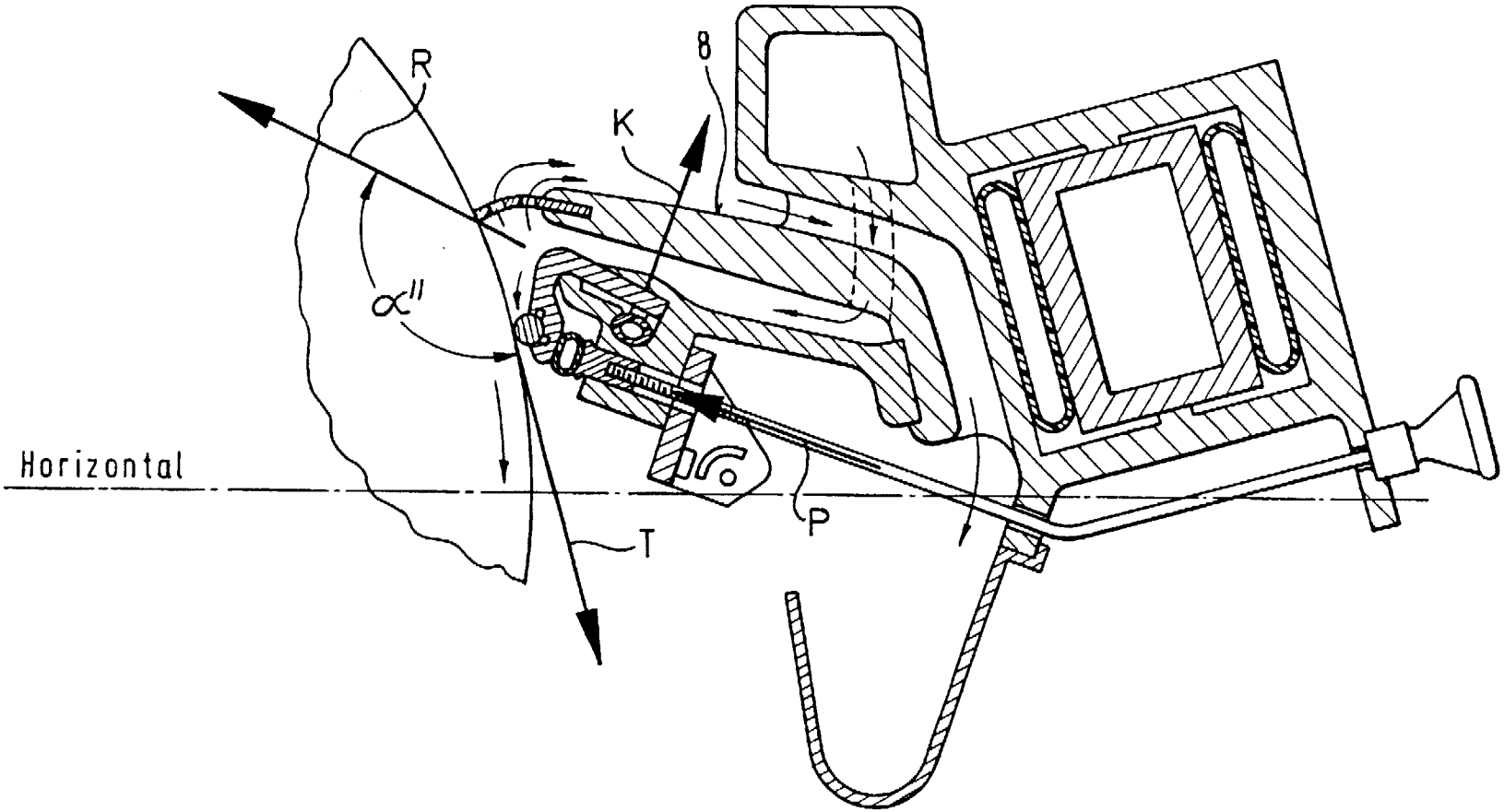
FIG. 9 shows a further exemplary embodiment of the inventive apparatus in a schematic cross section.

FIG. 9 shows a further exemplary embodiment of the application mechanism similar to that according to FIGS. 2 and 3, but for mounting approximately in the two o'clock position. The extension (arrow R) and the roller rotational direction (arrow T) as well as the pressing force of the blade element (arrow P) and the blade holder force (arrow K) are also depicted here.

What is claimed is:

1. Apparatus for the application of at least one liquid medium onto a moving material web comprising:

an application mechanism (3) for the liquid medium, and a roller (2) positioned and arranged near the application mechanism (3) for receiving the liquid medium on the roller surface in the case of indirectly applying the liquid medium to the material web or for guiding the material web (1) in the case of directly applying the medium to the material web and wherein:

the application mechanism (3) has a dosaging blade (4) and a damming strip (7) positioned and arranged at a distance from the dosaging blade with respect to the direction of rotation of the roller (2), the damming strip defining an application chamber (6) with the dosaging blade (4);

a running-off surface (8) is provided on the application mechanism (3) over which excess liquid medium passing out of the application chamber (6) over the damming strip (7) flows under the influence of gravitational force; and the dosaging blade (4) has a blade holder (5) with a base strip (5*b*) which is mounted in the application mechanism (3);

characterized in that the blade holder (5) is bent such that the cross-sectional extension (arrow R) of the base strip (5*b*) forms an angle ($\alpha$) with the roller rotational direction (arrow T) at the dosaging blade (4) of at least approximately 90° or more, and the application mechanism (3) is provided with a pressing device (18, 19, 20, 21) extending parallel the dosaging blade (4), said pressing device having a plurality of adjusting means for selectively adjusting the pressing force of the pressing device at each of a plurality of locations across the width of the roller.

2. Apparatus according to claim 1, characterized in that the application mechanism (3) is arranged in a sector of the shell surface of the roller (2) which moves downwardly.

3. Apparatus according to claim 2, characterized in that the running-off surface (8) forms an acute angle ($\alpha$) with a horizontal plane (26).

4. Apparatus according to claim 3, characterized in that the downwardly moving sector of the surface of the roller (2), with reference to a horizontal plane passing through the roller axis, extends about an arcuate angular region of 30° upwards and an arcuate angular region of 90° downwards.

5. Apparatus according to claim 1, characterized in that a downwardly moving sector of the surface of the roller (2) extends downwards from a horizontal plane passing through the roller axis about an arcuate angular region of approximately 90°.

6. Apparatus according to claim 1, characterized in that the pressing force is adjustable manually or automatically by means of adjusting elements (20, 21; 24, 21).

7. Apparatus according to claim 6, characterized in that the adjusting elements are bendable spindle shafts (20).

8. Apparatus according to claim 7, characterized in that the blade holder (5) is arranged in the application mechanism (3) so that the force (K) which holds the blade holder (5) in the application mechanism (3) is approximately perpendicular to the force (P) which presses the dosaging blade (4) against the roller.

9. Apparatus according to claim 1, characterized in that a supply channel (11) is provided for each of the liquid medium and the running-off surface (8), and one supply channel extends within the application mechanism (3) on an opposite side of the damming strip (7) from the other supply channel with reference to the roller peripheral direction.

10. Apparatus according to claim 1, characterized in that a supply channel (11) is provided for each of the liquid medium and the running-off surface (8), and one supply channel extends in the application mechanism (3) on the same side of the damming strip (7) as the other supply channel with reference to the roller peripheral direction.

11. Apparatus according to claim 10, characterized in that the supply channel (11) and an overflow channel (25) cross each other within the application mechanism (3).

12. Apparatus according to claim 1, characterized in that a supply gap (9) for supplying the liquid medium into the application chamber (6) enters approximately radially into this in the application mechanism (3) with reference to the roller axis.

* * * * *